US006085612A

United States Patent [19]

Thorn et al.

[11] Patent Number: 6,085,612

[45] Date of Patent: Jul. 11, 2000

[54] ELASTOMER DETENT ASSEMBLY

[75] Inventors: Richard P. Thorn; Denise M. Braeger, both of Erie, Pa.

[73] Assignee: Lord Corporation, Cary, N.C.

[21] Appl. No.: 09/129,757

[22] Filed: Aug. 5, 1998

[51] Int. Cl.[7] ..... G05G 5/16

[52] U.S. Cl. ..... 74/531; 74/527

[58] Field of Search ..... 74/527, 531; 248/292.12

[56] References Cited

U.S. PATENT DOCUMENTS

| | | | |
|---|---|---|---|
| 2,685,812 | 8/1954 | Dmitroff | 85/61 |
| 2,909,047 | 10/1959 | Walterschied-Müller et al. | 64/29 |
| 3,350,042 | 10/1967 | Stewart et al. | 248/22 |
| 4,004,506 | 1/1977 | McInerny | 101/110 |
| 4,006,787 | 2/1977 | Rumpp et al. | 173/132 |
| 4,038,508 | 7/1977 | Mapelsden | 74/531 |
| 4,455,886 | 6/1984 | Schmitt | 74/531 |
| 4,521,650 | 6/1985 | Oswald | 74/531 |
| 4,766,641 | 8/1988 | Daglow | 15/390 |
| 4,878,880 | 11/1989 | Williams | 464/37 |
| 4,955,253 | 9/1990 | Sakai et al. | 74/531 |
| 4,984,776 | 1/1991 | Smith | 267/276 |
| 5,146,808 | 9/1992 | Hoshino | 74/531 |
| 5,150,851 | 9/1992 | Manusch et al. | 242/68.1 |
| 5,190,390 | 3/1993 | Ming-Tai | 74/531 |
| 5,589,671 | 12/1996 | Hackbarth et al. | 74/527 |
| 5,590,564 | 1/1997 | Kishimoto | 74/527 |
| 5,632,517 | 5/1997 | Paulik et al. | 292/216 |

*Primary Examiner*—David A. Bucci
*Assistant Examiner*—Chong H. Kim
*Attorney, Agent, or Firm*—Randall S. Wayland; James W. Wright

[57] ABSTRACT

An elastomer detent assembly includes a first member and a second member. The first member includes a plurality of recesses formed in a surface thereof. The second member is engagable with the plurality of recesses and includes at least one detent finger. A dimension of the at least one detent finger is sized relative to a comparable dimension of the surface such that, upon application of a force, the at least one detent finger will move in finite increments relative to the first member providing a detent mechanism. At least one of the first and second members further includes an elastomer portion and a radially extending flange for limiting axial motion between the members. Embodiments including elastomer bonded to either an inner or an outer member are provided.

6 Claims, 6 Drawing Sheets

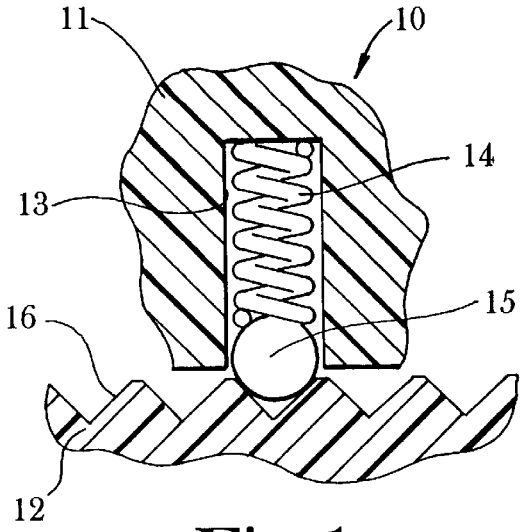
Fig 1
Prior Art
Fig. 2a
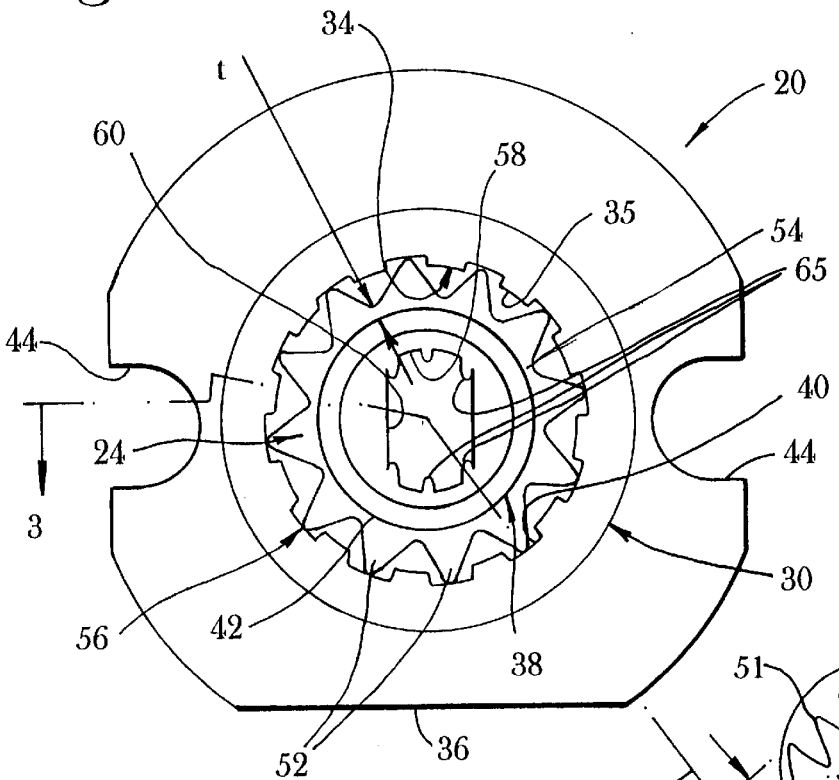
Fig. 2b
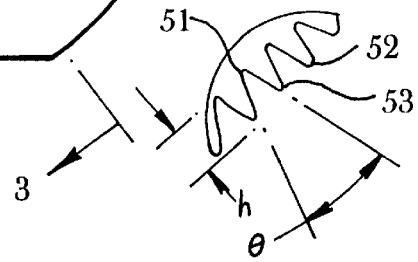

Fig. 5
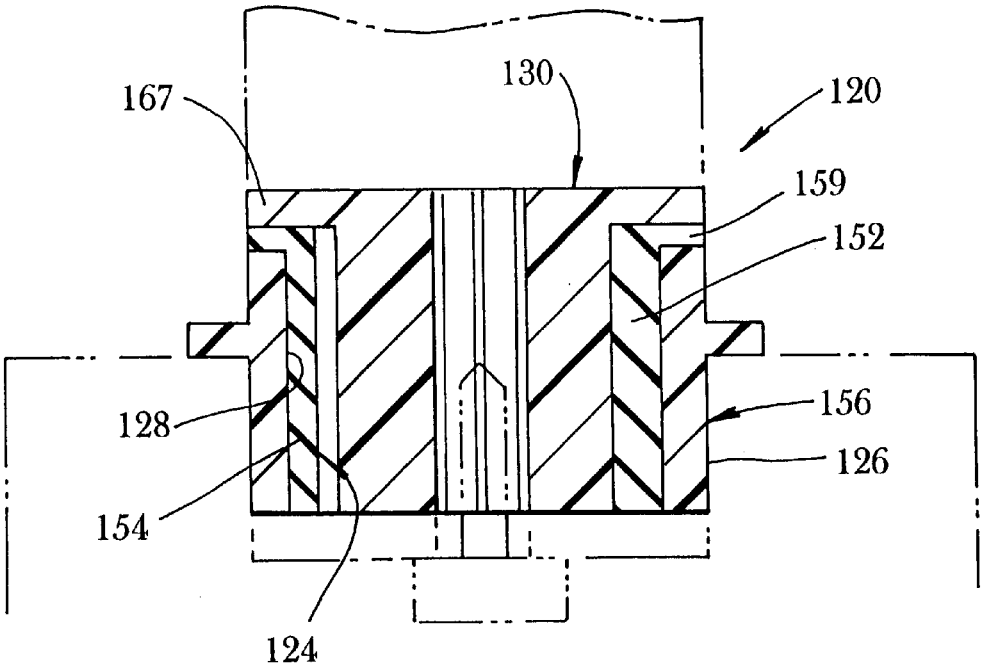
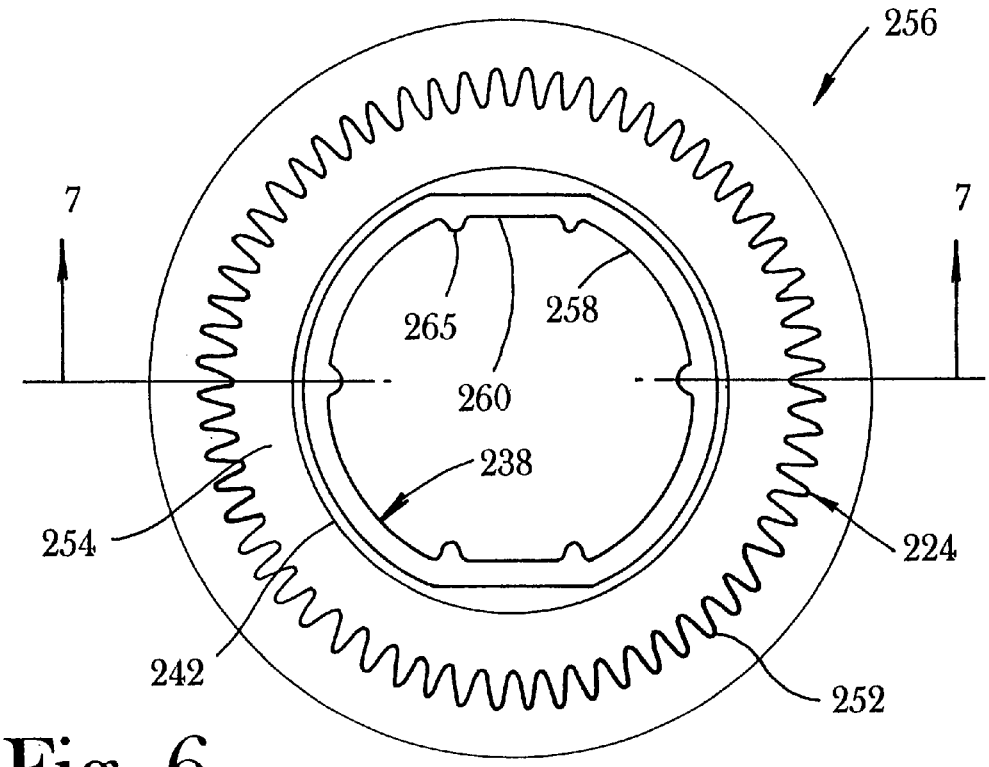
Fig. 6

ELASTOMER DETENT ASSEMBLY

FIELD OF THE INVENTION

The invention relates to detent mechanisms. More particularly, the present invention is directed to an elastomer assembly operative to provide an incremental detent feature.

BACKGROUND OF THE INVENTION

Detent mechanisms 10 of the prior art, as best shown in FIG. 1, include a coil-spring 14 biasing a spherical steel ball 15. The ball 15 is slideable in a race 13 formed into a housing 11 to positively locate the ball 15 into one of a series of adjacent groves 16 that are formed in a base 12. The bias provided by the spring 14 ensures that the ball 15 cannot be moved to the next adjacent groove 16 until a predetermined level of force or torque is provided, upon which, the ball 15 will snap into the next adjacent groove 16. Since the ball 15 will only come to rest in a groove 16, a ratchet or detent mechanism is provided whereby the position of the housing 11 may be adjusted relative to the base 12 in finite increments. Such devices are currently available on chairs to allow the chair arm to be adjusted in increments relative to its support base. An example of a rotary detent mechanism employing a similar mechanical elements can be found in FIG. 4 of U.S. Pat. No. 2,909,047 to Walterschied-Muller et al entitled "Overload Clutch."

Although these mechanical detent mechanisms 10 provide an effective incremental detent function, they tend to be noisy and have an undesirable very rigid and mechanical feel. For example, when such devices are implemented in repositionable arms of office chairs, the clicking noise resulting from adjustments is an annoyance.

U.S. Pat. No. 4,004,506 to McInerny entitled "Endorser Drum Having Indexable Self-Aligning Print Wheels" describes an annular-shaped elastomer print wheel 10 having a plurality of grooves 14 and a pin 16 having a plurality of splines 18 which engage therewith. Upon application of a torque to the print wheel, the splines 18 will snap into adjacent ones of the grooves 14. However, the '506 McInerny device cannot carry axial loads, thus it is ineffective in bushing applications. Accordingly, there has been a long felt, and unmet, need for a smooth and quite detent mechanism capable of providing a fine incremental detent function and which is capable of carrying axial loads.

SUMMARY OF THE INVENTION

The present invention provides an elastomer detent assembly which provides a smooth and quiet detent function. According to the invention, the elastomer detent assembly comprises a first member including a plurality of preferably axially extending recesses formed in its surface and a second member relatively moveable with respect to the first member and which includes at least one detent finger which engages with the plurality of recesses. More preferably, a plurality of detent fingers are provided. The dimension of the at least one detent finger is sized relative to a comparable dimension of the first member's surface, such that upon application of a small force or torque, the detent finger(s) will move in finite increments relative to said first member providing the detent mechanism. At least one of the first and second members includes an elastomer portion which most preferably comprises the detent finger (s). A flange is provided to limit axial motion between the members.

In another preferred aspect, the at least one detent finger extends from a central body of elastomer. The central body being of sufficient thickness to enhance the smooth detent feel of the assembly. In a first preferred embodiment in accordance with the invention, the second member comprises an inner member having an elastomer portion bonded to an outer surface thereof. Contrarily, in a second embodiment, the second member comprises an outer member having said elastomer portion bonded to an inner surface thereof.

It is also preferable that one of the members further comprises a radially extending elastomer flange which overlies the outer member and restrains and limits axial motion between the members in an axial direction. In each embodiment of elastomer detent assembly, preferably one of said first and second members includes an axial bore, which preferably includes an axially extending flat or another like rotational restraint, which receives a like-shaped attachment piece.

In a more detailed aspect, the at least one finger includes a taper which extends from its base to a tip thereof. Preferably, the finger(s) and recesses are sized such that a torque between about 2 in. lb. and about 12 in. lb. is required to move the members relative to each other. It is preferable that the elastomer portion comprise at least 12 detent fingers, and most preferably about 60 detent fingers which are preferably manufactured from elastomer.

The detent assembly is useful for providing a smooth detent function between any two relatively moveable members.

The detent assembly advantageously provides a very quiet damped detent function which is barely audible, but which can be felt, when making positional adjustments.

Furthermore, the detent assembly also advantageously provides a smooth transition between various incremental detent positions.

Moreover, the detent assembly advantageously may provide a very fine detent adjustment.

Further, the detent assembly, in its preferred form, advantageously provides a pivotal capability in combination with detent function.

Further, the detent assembly, in its preferred form, advantageously provides the ability to limit axial motions in combination with detent function.

The detent assembly, when used as part of a chair arm adjustment mechanism, advantageously provides for smooth, quite and fine rotational adjustment of the chair arm relative to its support and provides axial motion limiting.

The detent assembly advantageously may be utilized with a wide variety of outer member configurations wherever a smooth detent function is needed, such as with any form of adjustment knob or mechanism.

The above-mentioned and further features, advantages, and characteristics of the present invention will become apparent from the accompanying descriptions of the preferred embodiments and attached drawings.

BRIEF DESCRIPTION OF THE DRAWINGS

The invention will become better understood by reference to the description that follows, in conjunction with the appended drawings, in which:

FIG. 1 is a sectioned frontal view of a prior art detent mechanism;

FIG. 2*a* is a bottom view of the elastomer detent assembly in accordance with the present invention;

FIG. 2*b* is a partial end view of the elastomer detent fingers in accordance with the present invention;

FIG. 5 is a sectioned side view of the elastomer detent assembly along line 5—5 of FIG. 4;

FIG. 6 is a bottom view of an alternate embodiment of elastomer detent assembly in accordance with the present invention;

DETAILED DESCRIPTION OF THE PREFERRED EMBODIMENT

Figure 3:
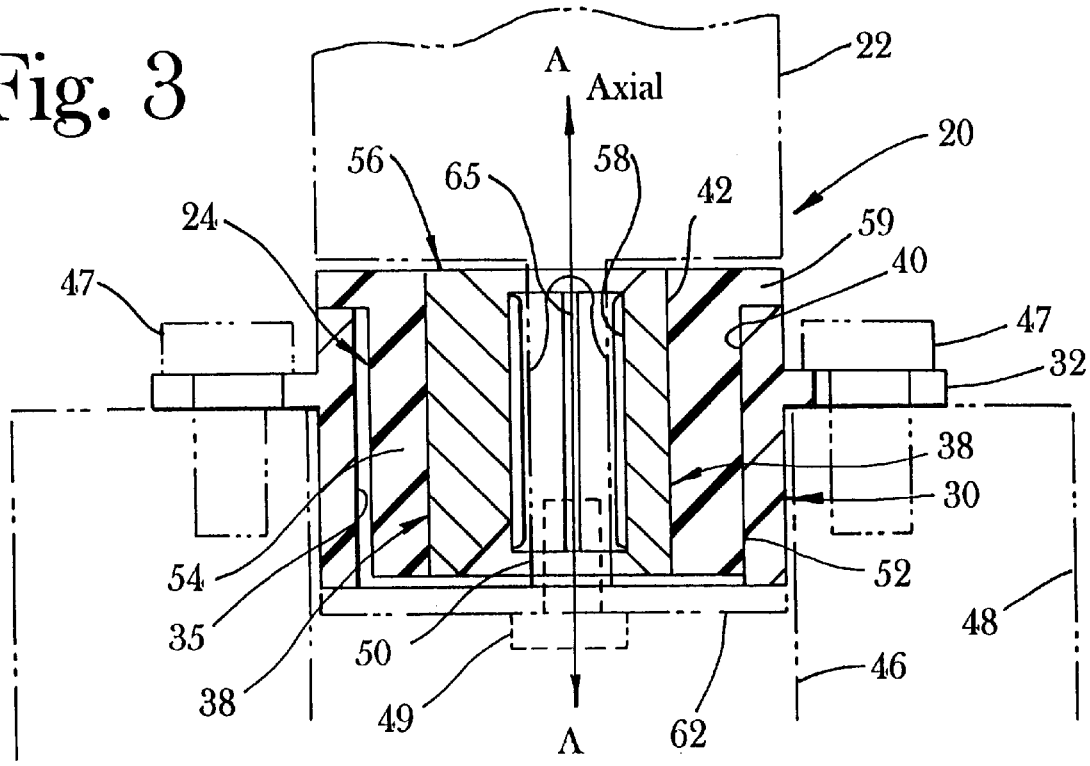
FIG. 3 is a sectioned frontal view of the detent assembly along line 3—3 of FIG. 2*a;*

A first embodiment of elastomer detent assembly 20 according to the present invention is illustrated in FIGS. 2*a* and 3. The elastomer detent assembly 20, which preferably takes the form of a bushing assembly, comprises a first member 30 cooperative and moveable in finite rotational increments relative to a second member 56. The first member 30 is preferably received in a cavity 46 formed in a housing 48, while the attachment member 22, such as an chair arm member, is received in the second member 56. The first member 30, such as the outer member shown, includes a plurality of axially extending recesses 40 formed in an inner peripheral surface 35 of a preferably circular-shaped axial hole 34.

The recesses 40 preferably take the form of grooves including a flat bottom and right-angled flat sides, which preferably extend entirely across the member 30 from the top to bottom. Preferably, the recesses 40 are equally spaced about the radial periphery of the hole 34. To provide a fine incremental detent function, it is preferable that there be at least 12, and more preferably about 60 (see FIG. 6) equally-spaced recesses 40. Preferably, the member 30 is manufactured from steel, aluminum, plastic or other rigid substantially non-extensible material.

The second member 56 is preferably rotatably engagable and cooperative with the plurality of recesses 40. The second member 56 includes at least one detent finger 52, and most preferably, a plurality of detent fingers 52 equally spaced about the radial outer surface 42 of the cylindrically-shaped inner member 38. In the embodiment shown, there are at least 12 detent fingers, however, if a very fine detent function is required, about 60 detent fingers are desired (see FIG. 2*b*). This higher number of fingers 52 provides a smooth detent feel with very fine increments. (approximately 1 detent for every 6 degrees of rotation). Notably, when at rest, the fingers 52 are preferably received in the recesses 40.

The radial dimensions of the at least one detent finger 52 are appropriately sized relative to a comparable radial dimension to the top surface 35 of hole 34, such that upon application of a small force by a human user (the word force denoting either force or torque), the members 30, 56 will rotate relative to one another. Such dimensions are further described with reference to FIG. 4. Preferably, a torque in the range of between about 2 (0.27 N-m) to about 12 in. lb. (1.36 N-m) is desired to initiate rotation between the members. It is the inventor's belief that such a range will provide a sufficient resistance to rotation when the fingers 52 are located in the recesses 40, yet not require large applied forces to initiate the rotation to the next incremental position in the adjacent recesses 40. This range will facilitate ease of adjustment by the user for most applications.

Upon the application of force, the at least one detent finger 52 will move in finite increments relative to the recesses 40 formed in the first member 30 thereby providing the detent mechanism. Notably, it is required that at least one of the first and second members 30 or 56 includes an elastomer portion 24 to provide the smooth detent feel. Most preferably, the fingers 52 comprise elastomer.

In more detail, referring again to FIGS. 2*a* and 3, the first member 30 includes a radially extending flange 32 projecting from the outer surface of the first member 30. This flange 32 may include a flat 36 and/or slots 44 as the means for restraining rotation of the member 30 relative to the housing 48. In the embodiment shown, the first member 30 is preferably received in a bore 46 formed in a housing 48 or other like member and fastened into the housing 48 by bolts 47 received in slots 44. However, it should be understood that the shape of the first member shown is merely exemplary, and that the first (outer) member 30 may be of any desirable shape required for the application provided it includes the required recesses 40.

The second member 56 preferably includes an outer elastomer portion 24 bonded to an outer surface 42 of the inner member 38. The inner member 38 is preferably manufactured from a plastic material, such as Nylon. The at least one detent finger 52 and more preferably, all the plurality of detent fingers 52, extends from a central body of elastomer 54 which surrounds the inner member 38. An elastomer flange 59 also extends from the upper portion of the elastomer body 54. Together, the central body 54, plurality of fingers 52, and flange 59 comprise the elastomer portion 24. Preferably, the central body 54 is of sufficient thickness t as compared to the height h (FIG. 2b) from tip 53 to the base 51 of the finger(s) 52 to provide the appropriate feel. Preferably, the thickness t of the central body 54 is at least as great, and more preferably, slightly greater than the height h of the finger 52. It was discovered by the inventor that by having an elastomer body 54 of sufficient thickness t provides a much smoother detent feel.

Preferably, the elastomer used is a natural rubber. However, any other suitable elastomer having rubber-like properties may be used as well, such as natural and synthetic blends, nitrile, butyl, buna S, neoprene, Thermo-Plastic Elastomer (TPE), silicone or the like. Most preferably, the elastomer includes some form of internal lubrication to provide enhanced smoothness. Internal lubrication compounded into the elastomer is desired because external lubrication tends to drip and collect dirt and debris which can detract from the smoothness and appearance. However, external lubrication may be allowable in some applications.

Preferably, the radially extending elastomer flange 59 projects from the upper end of the elastomer body 54. The flange 59 overlies the upper end of the first member 30. Moreover, the flange 59 serves to position and limit the movement of the first member 30 relative to the second member 56 in the axial direction. The flange can be of any shape to accomplish this function. The second member 56 also preferably includes an axial bore 58 preferably extending through the inner member 38 in the axial direction and being preferably centrally located on the axial axis A—A passing through the assembly 20. The axial bore 58 axially receives the pilot 50 depending from the attachment piece 22. The bore 58 preferably includes means for restraining motion between the inner member 38 and pilot 50. These restraining means may comprise, for example, at least one, or, more preferably, a plurality of axially extending flats 60 formed on a wall portion thereof.

Preferably, a flat washer 62 and bolt 49 retain the attachment piece 22, which may be, for example, an adjustable arm of a chair, from axial movement relative to the housing 48, yet still allows rotation thereof. Preferably also included on the bore 58 are projections 65 to firmly grip the pilot 50 thereby reducing any slop between the pilot 50 and inner member 38. Preferably, these projections 65 comprise a plurality of ribs, preferably six, formed axially along the bore 58 and are sized relative to the dimensions of the pilot 50, such that a slight interference fit is obtained.

As best seen in FIG. 2*b*, the plurality of fingers 52 each preferably comprise a tapered portion which tapers from a base 51 of the finger 52 towards a terminal tip 53 thereof. Preferably, the tapered portion includes an included angle θ of about 32 degrees. Appropriate radii are provided at the base and tip 51, 53. The recesses 40 may be provided with a complimentary shape, as is described with reference to FIG. 10.

Figure 4:
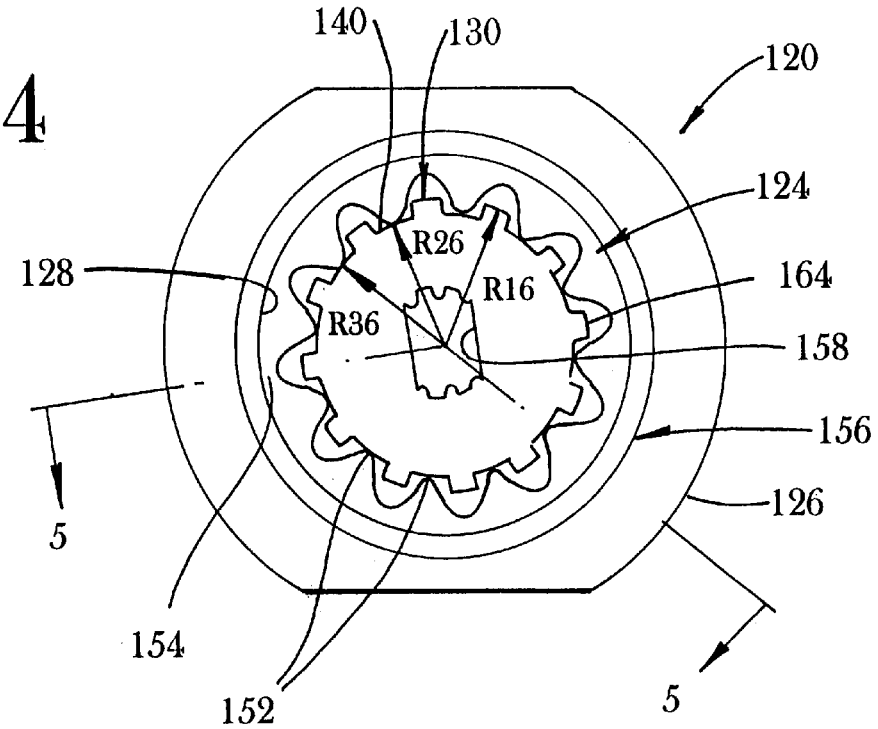
FIG. 4 is a bottom view of an alternate embodiment of elastomer detent assembly in accordance with the present invention.
Figure 7:
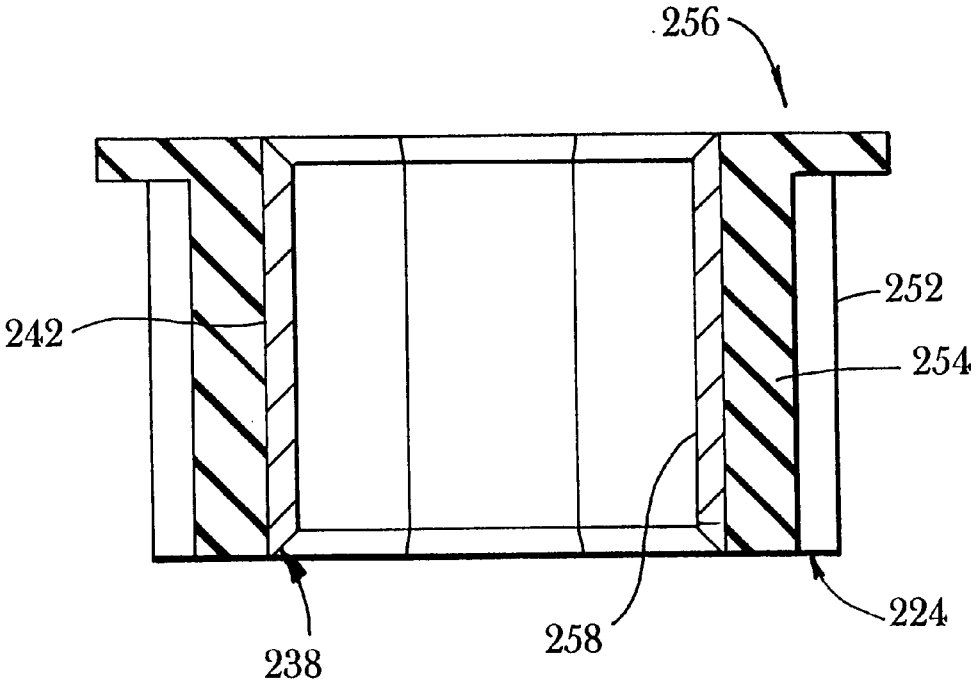
FIG. 7 is a sectioned side view of the elastomer detent assembly along line 7—7 of FIG. 6.
Figure 8:
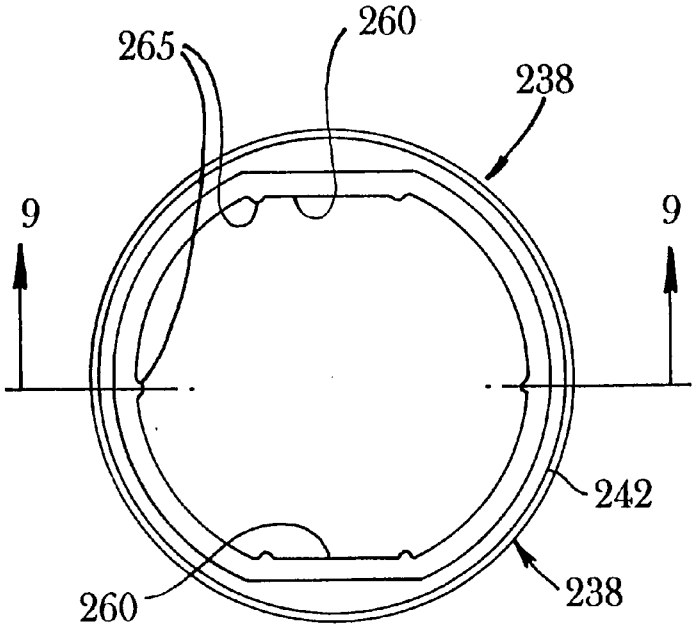
FIG. 8 is a top view of an inner member in accordance with the present invention.
Figure 9:
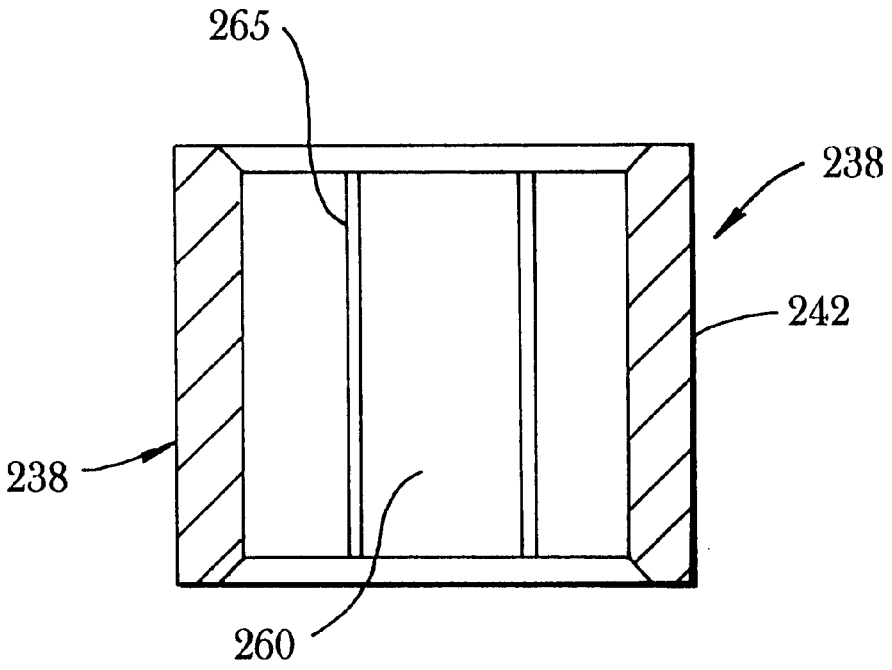
FIG. 9 is a sectioned side view of the inner member along line 9—9 of FIG. 8.

In FIGS. 4 and 5 is shown an alternate embodiment of the elastomer detent assembly 120. The main difference between this embodiment and the previous one is that the elastomer portion 124 is integrally bonded to the outer member 126 while the recesses 140 are formed on the outer surface 164 of the first (inner) member 130. The cylindrically-shaped, preferably Nylon, first member 130 includes an axial bore 158 formed in it similar to that previously described and includes a radially extending upper flange 167. The second member 156 includes the elastomer portion 124 including a body portion 154, a radially extending flange 159, and at least one, and more preferably, a plurality of fingers 152 extending from the body 154. The elastomer portion 124 is preferably integrally bonded to the inner surface 128 of the outer member 126 through a vulcanization process. The radially extending elastomer flange 159 overlies the outer member 126 and is overlaid by the flange 167 of the first member 130.

The radial dimensions R1*b* to the cylindrical surface 164, R2*b* to the terminal tips of fingers 152, and R3*b* to the base of the recesses 140 are appropriately sized, such that an appropriate design torque is required to move the assembly 120 between respective detent positions. The level of that design torque can be greatly varied, depending upon the relative dimensions between R1*b* and R2*b*. For example, the radius R1*b*, in this embodiment, will always be larger than the radius R2*b* to the tip of the finger 140 such that some interference is provided. The more interference, the greater the torque level required to move between respective detent positions. Likewise, the radius R3*b* to the base of the recess 140 will preferably be less than the radius R1*b* to the outer surface 164. The radius R3*b* should be slightly larger than the radius R2*b*, such that even while positioned in the recess 140, the finger 152 is being slightly compressed. This helps prevents slop while positioned in the recess 140. Notably, the recesses could be of any shape desired as long as all or a portion of the finger can be received therein and such that some level of small torque is required to move the finger to the next detent position.

FIG. 6–10 illustrate another embodiment of detent assembly 220 similar to that previously described, but with a very fine detent function. In this embodiment there are approximately 60 equal size, equally-spaced fingers 252 formed on the first member 256 which extend from the central body 254 of the elastomer portion 224. Preferably also, the elastomer portion 224 is bonded to the slightly tapered outer surface 242 of the inner member 238. The inner member 238 includes a bore 258 having a plurality of flats 260 and projections 265.

Figure 10:
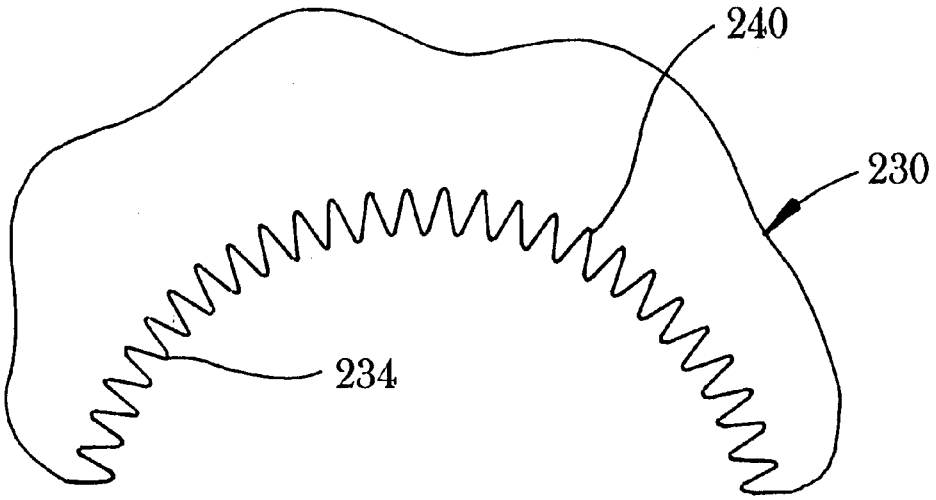
FIG. 10 is a partial top view of an alternate embodiment of outer member in accordance with the present invention.
Figure 11:
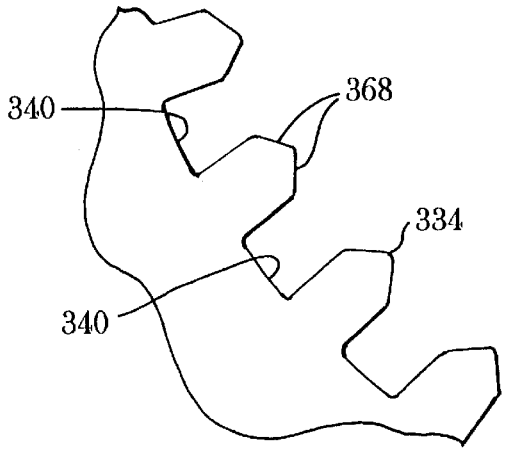
FIG. 11 is a partial top view of yet another embodiment of outer member in accordance with the present invention.

The first (outer) member 230, as best shown in FIG. 10, includes a plurality of recesses 240 which are complimentary in shape to the fingers 252 adapted to be received therein. For example, the recesses 240 include tapered sides and radii at the bases and tips thereof. Notably, the highest portions adjacent the recesses 240 corresponding to the tips define the axial bore 234. Preferably, it is desirable to have a minimum flat portion between the adjacent recesses 240 such that there will be a bias to force the fingers 252 to always reside in the recesses 240 under no torque conditions. This is preferably accomplished, as shown in FIG. 11 by including intersecting tapered portions 368 which cooperate to define the axial bore 334. The tapered portions 368 force the fingers (not shown) to always come to rest within the recesses 340.

Figure 12:
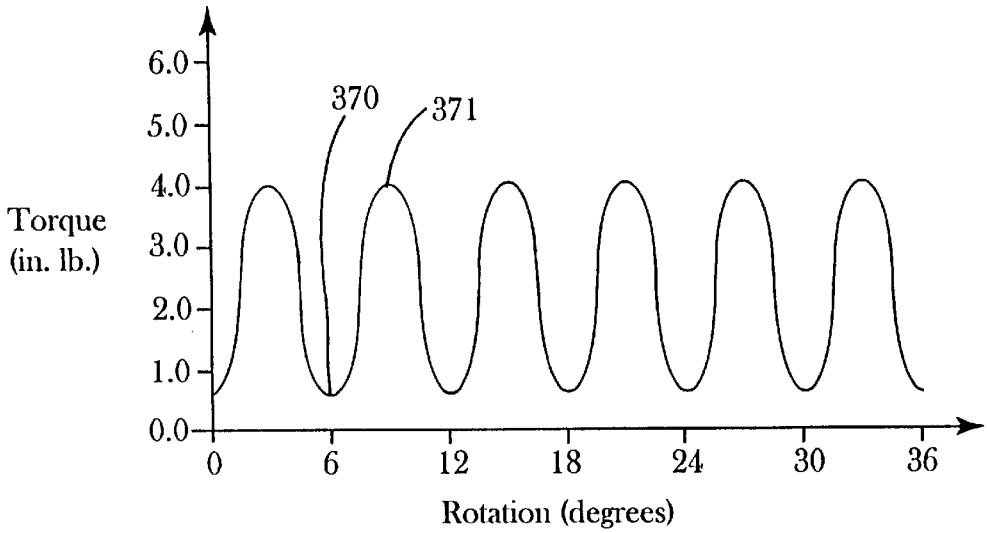
FIG. 12 is a graphical plot of torque versus rotation in accordance with the present invention.

FIG. 12 illustrates a typical torque versus rotation curve for the rotary detent assembly in accordance with an aspect of the present invention. The minimum torque values, such as at point 370, are representative of the finger being located within the recess, i.e., the point at which the finger is least flexed. Contrarily, the highest values, such as 371 correspond to where the finger is located at the axial bore portion, i.e., the point at which the finger is most flexed. Continuous rotation of the first member relative to the second member provides a continuous, but repeating, variation in torque, as shown.

The invention has been described in terms of preferred principles and structure, however, the particular examples given are meant to be illustrative and not limiting. Substitutions and equivalents as will occur to those skilled in the art are included within the scope of the invention as defined by the following claims.

What is claimed is:

1. An elastomer detent assembly, comprising:

(a) a first member including a plurality of recesses formed in a surface thereof, (b) a second member engagable with said plurality of recesses and including at least one detent finger, a dimension of said at least one detent finger being sized relative to a comparable dimension of said surface such that upon application of force, said at least one detent finder moves in finite increments relative to said first member providing a detent mechanism, and (c) wherein at least one of said first and second members further comprises an elastomer portion and a radially extending flange, and said second member comprises an outer member having said elastomer portion bonded to an inner cylindrical surface thereof.

2. An elastomer detent assembly, comprising:

(a) a first member including a plurality of recesses formed in a surface thereof, (b) a second member engagable with said plurality of recesses and including at least one detent finger, a dimension of said at least one detent finger being sized relative to a comparable dimension of said surface such that upon application of force, said at least one detent finder moves in finite increments relative to said first member providing a detent mechanism, and (c) wherein at least one of said first and second members further comprises an elastomer portion and a radially extending flange, wherein said second member comprises an inner member having said elastomer portion bonded to an outer cylindrical surface thereof.

3. An elastomer detent assembly of claim 2 wherein said inner member further comprises a radially extending elastomer flange.

4. An elastomer detent assembly, comprising:

(a) a first member including an axial hole having a plurality of recesses formed into an inner peripheral surface thereof, (b) a second member including an inner member, an elastomer portion bonded to an outer surface of said inner member, said elastomer portion including a plurality of detent fingers extending from a central body of elastomer, a radial dimension of said plurality of detent fingers being sized comparable to a radial dimension of said recesses and said inner peripheral surface such that upon application of a torque, said detent fingers rotate in finite increments relative to said first member thereby providing a detent mechanism.

5. An elastomer detent assembly, comprising:

(a) a first member including an axial hole having an inner surface and a plurality of axially extending recesses formed in said surface, (b) a second member including an inner member having an axial bore with at least one axially extending flat on a wall thereof, an elastomer portion bonded to an outer surface of said inner member, said elastomer portion including at least 12 detent fingers extending radially outwardly from a central elastomer body and including a radial elastomer flange, a radial dimension of said at least 12 detent fingers being sized relative to a comparable radial dimension of said axial hole such that upon application of a torque between about 2 in. lb. and about 12 in. lb., said second member rotates in finite increments relative to said first member thereby providing a detent mechanism.

6. An elastomer detent assembly, comprising:

(a) an first member including an outer peripheral surface having a plurality of recesses formed therein, (b) a second member including an outer member, an elastomer portion bonded to an inner cylindrical peripheral surface of said outer member, said elastomer portion including a plurality of detent fingers extending radially inward from a central body and a radially extending elastomer flange, a radial dimension of said plurality of detent fingers being sized relative to a comparable radial dimension of said outer peripheral surface such that upon an application of a torque, said first member rotates in finite increments relative to said second member thereby providing a detent mechanism.

* * * * *